US005255543A

United States Patent [19]

Wittman

[11] Patent Number: 5,255,543

[45] Date of Patent: Oct. 26, 1993

[54] OPENER FOR SECURITY PACKAGE WITH SPRING LOADED KEYING MECHANISM

[75] Inventor: Boyd C. Wittman, Shorewood, Minn.

[73] Assignee: Empak, Inc., Chanhassen, Minn.

[21] Appl. No.: 745,008

[22] Filed: Aug. 14, 1991

[51] Int. Cl.[5] ..... E05B 65/00

[52] U.S. Cl. ..... 70/57.1; 70/63; 70/401; 70/408; 70/409

[58] Field of Search ..... 70/57.1, 58, 63, 401, 70/408, 409; 24/3 F; 101/250–252, 269

[56] References Cited

U.S. PATENT DOCUMENTS

| | | | |
|---|---|---|---|
| 3,125,873 | 3/1964 | Robinson | 70/63 |
| 3,577,917 | 5/1971 | Nantz | 101/252 X |
| 3,650,209 | 3/1972 | Allport | 101/269 |
| 3,828,922 | 8/1974 | Holkestad | 70/63 X |
| 4,047,410 | 9/1977 | Close | 70/401 |
| 4,285,429 | 8/1981 | MacTavish | 70/63 X |
| 4,299,870 | 11/1981 | Humble | 70/57.1 X |
| 4,589,549 | 5/1986 | Hehn | 70/63 X |
| 4,993,245 | 2/1991 | Ott | 70/57.1 |

*Primary Examiner*—Renee S. Luebke
*Assistant Examiner*—Suzanne L. Dino
*Attorney, Agent, or Firm*—Haugen and Nikolai

[57] ABSTRACT

A device for opening security packages used to protect audio-visual media from being stolen is disclosed. The security package opening device includes a base which assists with proper positioning of the security package to be opened. It also includes a slidable opening mechanism which, when slid forward, automatically causes key elements to enter the locking means of the security package. The opening mechanism then opens the security package permitting the contents of the security package to be removed.

3 Claims, 4 Drawing Sheets 50
54
10
56
62
36
34
38
42
44
46
30
40
24
14
18
32
21
30
38
22
16
12
13

40
36
38
18
14
56
34
84
24
50
22
54
82
3
3
21
34
36
56
42
34
16
12

OPENER FOR SECURITY PACKAGE WITH SPRING LOADED KEYING MECHANISM

BACKGROUND OF THE INVENTION

1. Field of the Invention

The present invention relates to a device for opening security packages. More specifically, it relates to a device for easily opening security packages of the type used to prevent shoplifting of audio cassettes, video cassettes, compact disks or other small items which could be easily stolen from a store.

2. Background of the Invention

For some time there has been a need to secure small and relatively expensive audio-visual articles in security packages to inhibit shoplifting. U.S. Pat. No. 4,865,190 dated Sep. 12, 1989 shows a reusable security package ideally suited for this purpose. Security packages of the type shown in U.S. Pat. No. 4,865,190 have been very successful in the marketplace. They have proven to be an inexpensive and effective means for preventing shoplifting of audio-visual cassettes and disks.

In the past, store clerks have been supplied with hand held keys to open security packages of the type shown in the '190 patent. These keys do work effectively to open the lock. Parts of such keys can break, however, if uneven pressure is applied to the key as the lock is opened. The keys also can be clumsy to use. This is particularly the case when the clerk must open several security packages at a time or when there is a rush at the check out counter. Also the keys, themselves, can be lost or stolen because of their size. The present invention overcomes these disadvantages of the keys presently in use by providing a security package opening device which is quick, convenient and easy to use. It is also of a size which allows it to sit conveniently on a check out counter without any substantial risk that the opening device will be lost or stolen.

In an effort to overcome the problems set forth above, the inventor invented the devices disclosed and claimed in U.S. patent application Ser. No. 07/667,531, now U.S. Pat. No. 5,129,244. That application discloses a security package opening device having a housing comprised of a base, an end plate, and a pair of side rails. The side rails have aligned grooves which receive rollers associated with an opening mechanism. The opening mechanism slides back and forth in the grooves. The opening mechanism includes means for rotatably mounting the key. The present invention represents a more compact opening device which is cheaper to manufacture than the system shown in this earlier application.

SUMMARY OF THE INVENTION

The purpose of the invention is to provide a device for opening security packages of the type generally shown in U.S. Pat. No. 4,865,190. The device has a base including a slot in which the locked security package is inserted. The walls and surfaces of the slot index the locked security package in the proper position for opening. The base also has a pair of opposing guide channels which retain and index an opening mechanism which can be moved generally up and down in the guide channels. The base also includes one or more slots which retain springs which serve to bias the opening mechanism in its "up" position. The opening mechanism includes a handle member and means for securing in proper position a key designed to open the lock of the security package.

When used, the end of the security package which retains the cassette or disk is inserted through the slot until it reaches its properly indexed position. The operator then pushes the handle down until the key enters the lock of the security package. The operator can then release the handle allowing the springs to push the opening mechanism up. This action unlocks and opens the security package. After the security package is opened, the operator removes the security package from the opener, the cassette or disk "jewel box" from the security package.

The principle object of the present invention is to provide a device for quickly and easily opening reusable security packages of the type used in stores to protect audio-visual media from shoplifting.

Another object of the present invention is to provide a device for opening such a security package having a spring biased, slidable opening mechanism and means for properly indexing the security package in the device.

Still another object of the invention is to provide a device for opening a security package which can accommodate security packages of differing sizes or having differing locking mechanisms.

A further object of the invention is to provide a device for opening a security package which can accommodate different keys.

Another object of the present invention is to provide a security package opening device which is relatively inexpensive and easy to use.

Another object of the invention is to provide a device which will easily open the security package and help protect the opening elements of the key from damage or breakage due to uneven stress or pressure.

Another object of the present invention is to provide a compact, inexpensive device for quickly and easily opening a security package.

Still another object of the present invention is to provide a security package opener which is rugged and durable.

These and other objects of the present invention will be readily apparent from a review of the following detailed description of the preferred embodiment in conjunction with the accompanying drawings and claims.

DETAILED DESCRIPTION OF THE PREFERRED EMBODIMENT

Figure 1:
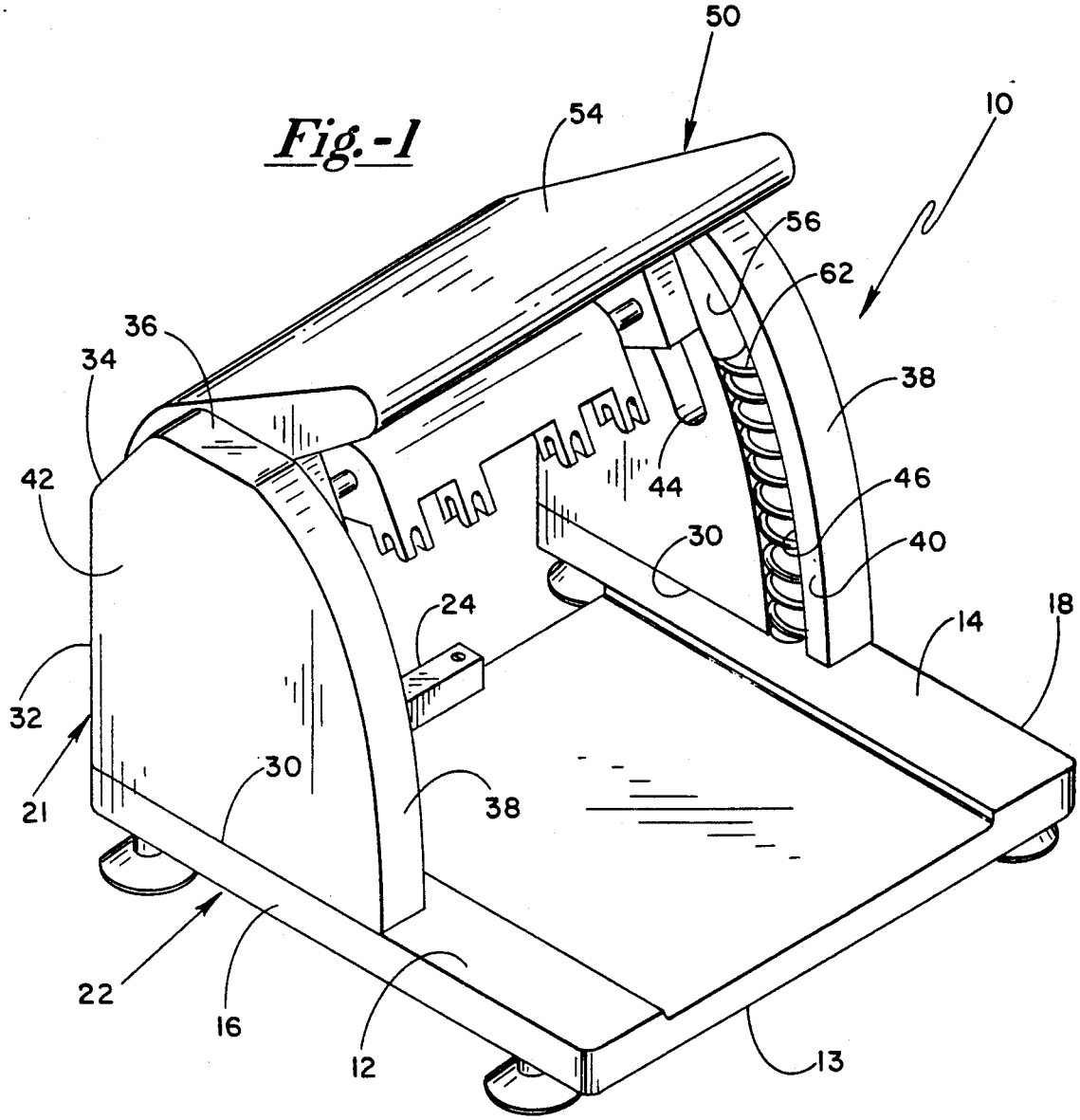
FIG. 1 is a perspective view of the opening device of the present invention.

FIG. 1 shows a perspective view of the security package opening device 10 of the present invention. As shown in the drawing, the opening device is comprised of a main housing 22 and a opening mechanism 50.

The main housing 22 has base 12. The base 12 has a flat bottom 13, a top 14, a pair of opposing side edges 16 and 18, a front edge, and a back edge. Projecting upwardly from the top 14 is stop plate 24. The main housing 22 also includes a pair of side rails 21. The two side rails 21 are parallel and spaced apart.

Each of said rails 21 has four straight edges (bottom edge 30, back edge 32, edge 34, and top edge 36) and a curved front edge 38. Each of side rails 21 also has an inside surface 40 and an outside surface 42. The inside surface 40 of each side rail has an arcuate groove 44 and an arcuate groove 46. The grooves 44 and 46 in one of the side rails 21 are aligned with the corresponding grooves 44 and 46 in the other side rail 21.

In the preferred embodiment, the base is made of aluminum. A durable plastic such as ABS could also be used. Other suitable materials can, of course, be used without deviating from the invention.

The slidable opening mechanism 50 has an elongated handle member 54. The slidable opening mechanism 50 is narrower than the distance between side rails 21. This permits the slidable opening mechanism 50 to fit between the side rails 21 and be moved down and up between the side rails 21 toward and away from the base 12 of the main housing 22.

Attached to each side of the slidable opening mechanism 50 is a Delrim plastic bearing guide 56. Each bearing guide 5 includes a guide element intended to be slidably received within the corresponding groove 44, and a bearing element intended to be slidably received within the corresponding groove 46. Preferably, each bearing guide 56 will be integrally molded. The bearing guides 56 are fastened to the slidable opening mechanism 50 using screws or other suitable attachment means.

As indicated above, when the device is assembled, the guide element of each bearing guide 56 resides in the corresponding groove 44. The relationship and orientation of the guide elements and the grooves 44 serve to index and retain the slidable opening mechanism 50 within the correct range of positions. The end walls of the grooves 44 serve as stops which prevent the slidable opening mechanism 50 from moving too far down or too far up. The walls of the grooves 44, in combination with the guide elements of the bearing guides 56, serve to keep the slidable opening mechanism 50 secured to the main housing 22 as the device is operated.

As best shown in FIG. 1, when the opening device of the present invention is assembled, a compression spring 62 is located in each groove 46. One end of the compression spring 62 is received within and abuts the bottom of a hole in the base 12 of the main housing 22. The other end of spring 64 abuts the bearing element of the bearing guide 56. As such, each spring 62 serves to bias the slidable opening mechanism 50 in its up position.

Figure 2:
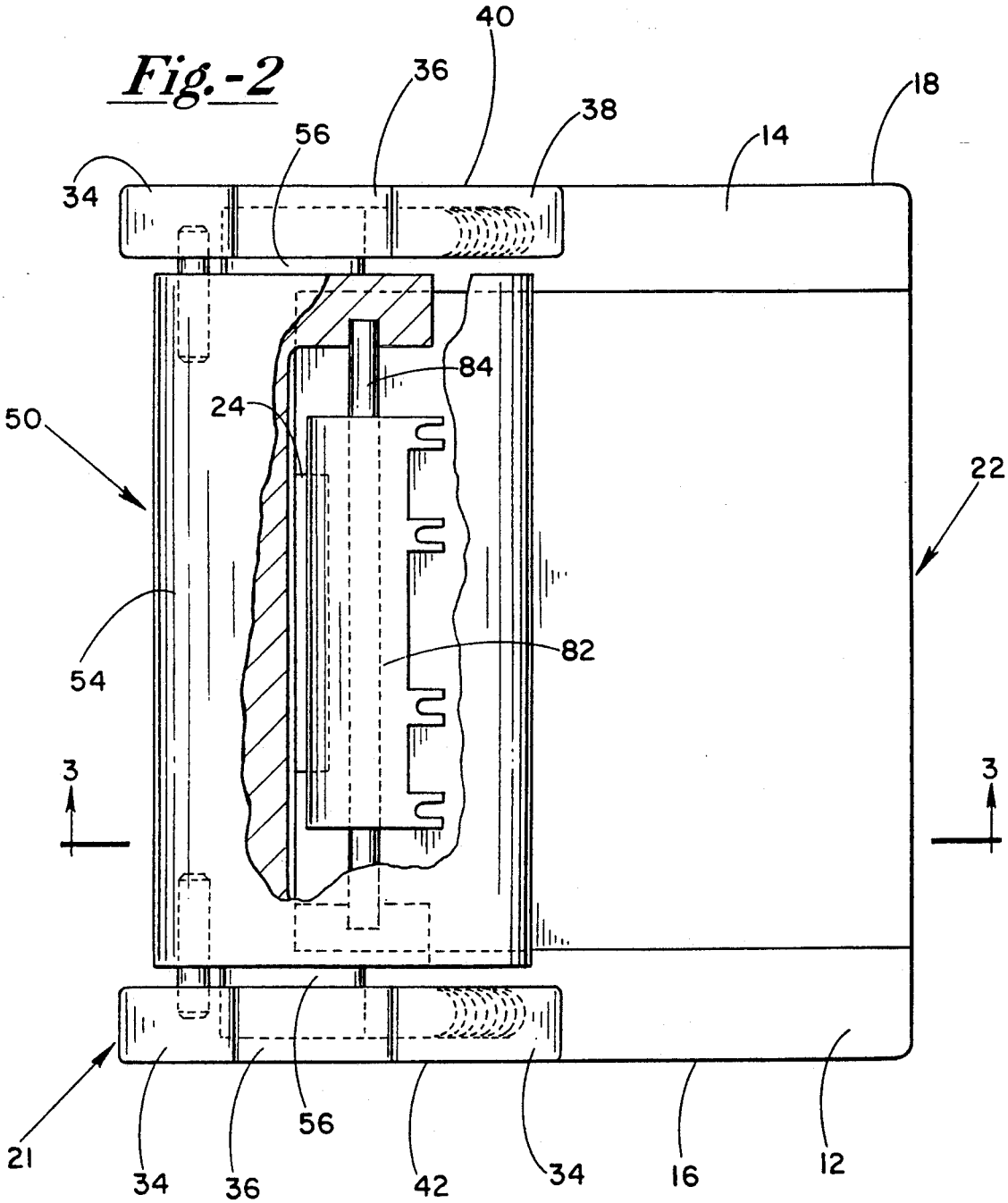
FIG. 2 is a partial sectional top plan view of the opening and device.
Figure 3:
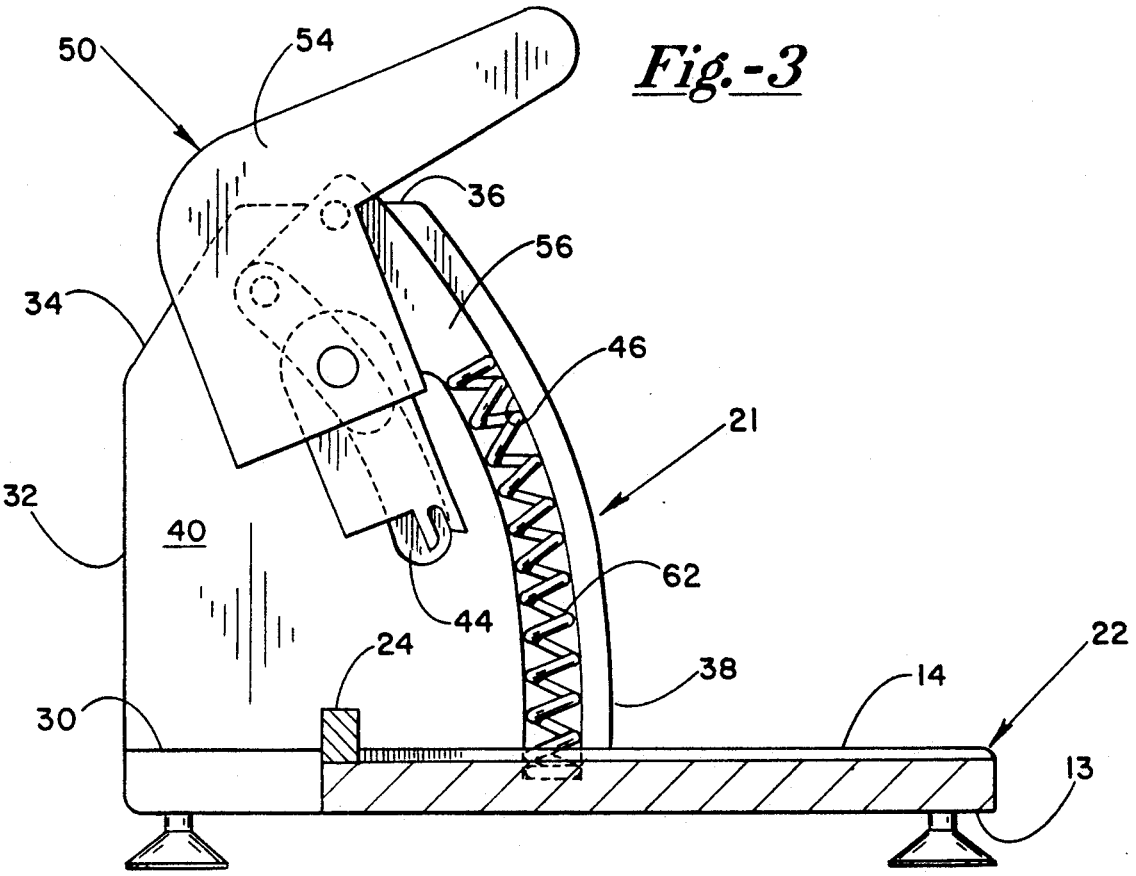
FIG. 3 is a partial sectional side elevation through line 3—3 of FIG. 2 with the handle in its up position.
Figure 4:
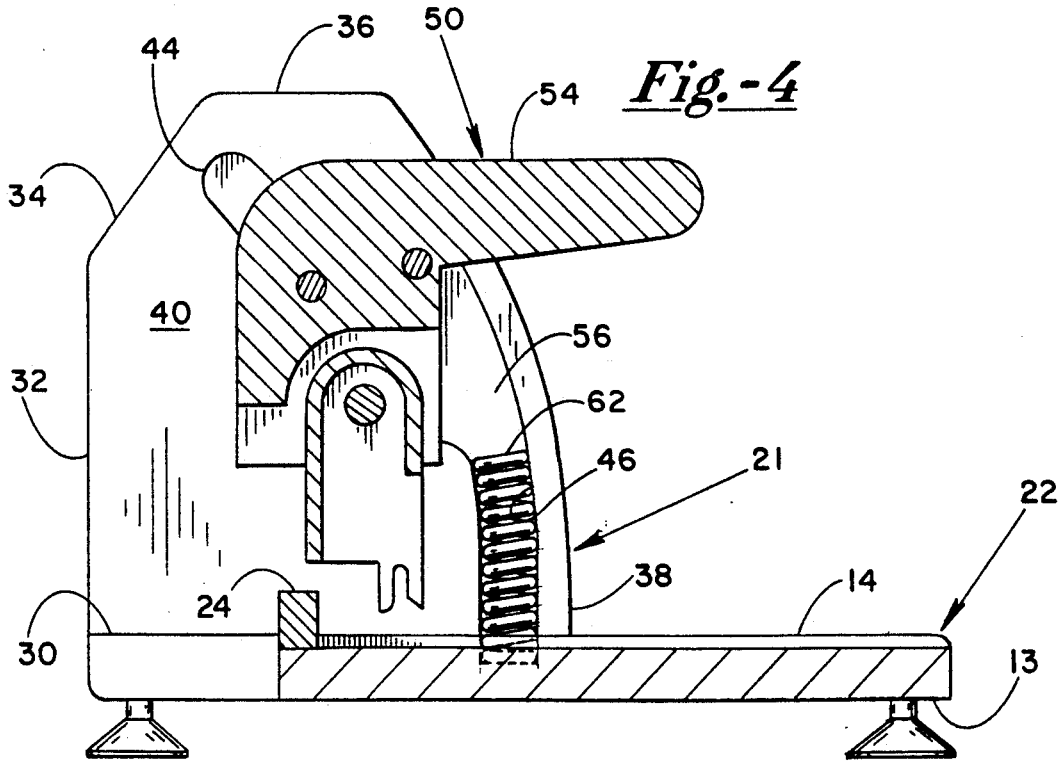
FIG. 4 is a cross-sectional view through line 3—3 of FIG. 2 with the handle in its down position.

FIG. 2 shows that the slidable opening mechanism 50 includes a hollowed out area in its bottom. This area is designed to receive an elongated key of the type used to open the devices disclosed in U.S. Pat. No. 4,865,190. Other keys to accommodate different locks on the security package could also be used without deviating from the invention. The hollowed out area is large enough to receive the key. Keys 82 designed to be used with the device of the present invention will preferably have a cylindrical bore extending through it so it can be held in place by the axle 84 shown in FIG. 2. The axle 84 is held in place by the slidable opening mechanism 50 because opposite ends of the axle are received and held in place by aligned bores in the slidable opening mechanism 50 which are located at opposite sides of the hollowed out area.

Figure 5:
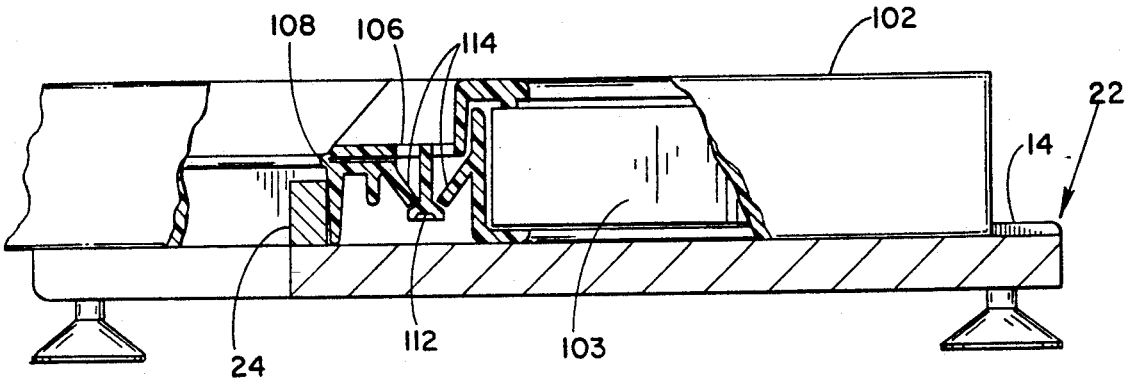
FIG. 5 is a partial sectional view showing a security package to be opened in position.

To fully understand the operation and advantages of the present invention, it is important to understand the structure of the security package it is designed to open. A full description of this security package is presented in U.S. Pat. No. 4,865,190 which is incorporated by reference. Briefly, however, and as shown in FIG. 5, such security packages have a rectangular structure 102 which receives and retains the item 103 to be held by the security package. The rectangular structure 102 has a locking mechanism associated with it. The locking mechanism has a plurality of catch ports 106, one of which is shown in cross sections in FIGS. 5 and 6. The locking mechanism also has a living hinge 108 along one side of the catch ports 106. Secured to the opposite side of the living hinge 108 are latch means 112 aligned with the catch ports 106. The security package is locked by rotation of the latch means 112 about the living hinge 108 and insertion of the latch means 112 in the catch ports 106. The catch ports 106 have opposing angled teeth 114 which engage opposing beveled surfaces on the latch means 112 for mating with an end surface on the angled teeth 114.

Figure 6:
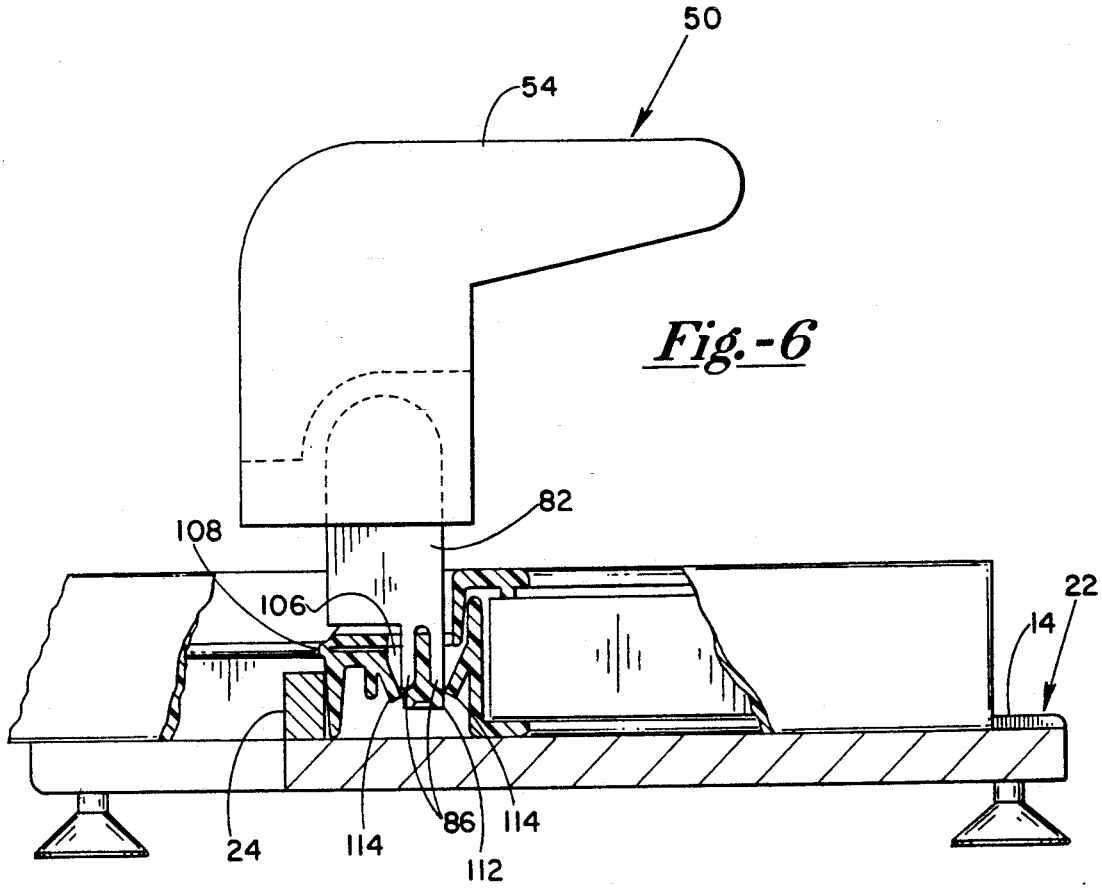
FIG. 6 is a partial sectional view showing a security package to be opened with the key in its engaged position.

The key 82 for opening the package includes elements 86 which enter the catch ports 106 and spread the teeth 114 away from the beveled surfaces on the latches 112 releasing the latches 112 and unlocking the security package. FIG. 6 shows the key 82 in its engaged position with elements 86 in the catch port 106 spreading the teeth 114 away from the beveled surface of the latch means 112.

Operation of the present invention will now be discussed. With the device sitting on a countertop, stand or table, the operator inserts the locked security package into the device from the back between the base and the slidable opening mechanism 50. The rectangular structure 102 of the security package is inserted first with the locking mechanism facing up. The operator continues advancing the security package until it reaches the proper position. A stop plate 24, located on the base, engages a corresponding surface on the package to ensure proper positioning of the security package.

The operator then pushes down on the handle (which serves as a lever) overcoming the force of the springs 62. This causes the slidable opening mechanism 50 to advance down the groove 44 so that the key elements 86 of key 82 enter the catch ports 106 of the security package. The elements 86 then spread the angled teeth 114 releasing the latches 112 from the catch ports 106. The operator then releases the handle 54. This action causes the springs 62 to push the slidable opening mechanism 50 upward. At the same time, the latches 112 are pulled out of the catch ports 106 and the security package is unlocked. The security package is, thus, opened, permitting removal of the tape, video or disk jewel box from the rectangular member 102 of the security package.

Various modifications can be made to the present invention without departing from its scope.

What is claimed is:

1. A device for opening a security package comprising:

(a) a main housing including a base, a stop plate projecting upwardly from the base, a first side rail projecting upwardly from one side of the base, a second side rail projecting upwardly from the opposite side of the base, said side rails having first opposing, aligned, elongated, parallel grooves;

(b) a slidable opening mechanism dimensioned to fit between the side rails, a pair of guide elements attached to each side of a block, said guide elements dimensioned to fit within said grooves on said side rails when said slidable opening mechanism is attached to the main housing, so that the slidable opening mechanism can move between up and down positions, said slidable opening mechanism further including a handle projecting rearwardly from said block, and means for mounting a key to said block, said housing and said slidable opening mechanism forming a channel into which the security package to be opened cam be inserted; and (c) means for biasing said slidable opening mechanism toward its up position.

2. A device for opening a lock of a security package used to prevent shoplifting, said device including:

(a) a housing having a base, and a pair of opposing side rails forming a channel into which the security package may be inserted;

(b) a block having an up position and a down position;

(c) means for biasing said block toward its up position;

(d) means for securing said block to said housing so that said block can slide between its up and down position between said side rails;

(e) means for mounting a key to said block so that a key will enter and open the lock of a security package in the channel as the biasing means are overcome and the block is slid down toward said base and will open the security package in the channel as the block is then slid away from the base.

3. The apparatus of claim 1 wherein said biasing means include a second opposing aligned, groove in at least one of said side rails, a compression spring located within said second groove; said spring having one end in contact with the base and its other end in contact with a bearing element of one of each guide element.

* * * * *